US006739843B2

(12) United States Patent
Umemura et al.

(10) Patent No.: US 6,739,843 B2
(45) Date of Patent: May 25, 2004

(54) CONTROL VALVE AND VARIABLE DISPLACEMENT COMPRESSOR HAVING THE SAME

(75) Inventors: Satoshi Umemura, Kariya (JP); Kazuhiko Minami, Kariya (JP); Tatsuya Hirose, Kariya (JP); Masami Niwa, Kariya (JP); Yuji Hashimoto, Kariya (JP); Masaki Ota, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 77 days.

(21) Appl. No.: 10/189,038

(22) Filed: Jul. 3, 2002

(65) Prior Publication Data

US 2003/0007878 A1 Jan. 9, 2003

(30) Foreign Application Priority Data

Jul. 4, 2001 (JP) ..... 2001-202840

(51) Int. Cl.[7] ..... F04B 1/26

(52) U.S. Cl. ..... 417/222.2; 417/269; 251/129.15; 335/281

(58) Field of Search ..... 417/222.2, 222.1, 417/269; 251/129.15

(56) References Cited

U.S. PATENT DOCUMENTS 2,997,633 A * 8/1961 Ellis et al. ..... 335/281
4,810,985 A * 3/1989 Mesenich ..... 335/261
5,735,375 A * 4/1998 Booth et al. ..... 335/281
5,964,578 A 10/1999 Suitou et al. ..... 417/222.2

FOREIGN PATENT DOCUMENTS

| | | |
|---|---|---|
| EP | 1 026 398 A2 | 8/2000 |
| JP | 63-47957 | 9/1988 |
| JP | 06-233481 | 8/1994 |
| JP | 9-268974 | 10/1997 |
| JP | 2000-291542 | 10/2000 |

* cited by examiner

*Primary Examiner*—Cheryl J. Tyler
(74) *Attorney, Agent, or Firm*—Morgan & Finnegan, LLP

(57) ABSTRACT

A control valve has a valve body for opening and closing a valve hole and a solenoid mechanism for urging the valve body by energizing a solenoid. The solenoid mechanism includes a yoke, a plunger housing, a fixed core and a plunger. The yoke accommodates the solenoid and forms a magnetic path. The plunger housing made of stainless steel connects with the yoke, and has a central axis. The fixed core connects with the yoke. The plunger is accommodated in the plunger housing and connects with the valve body. The plunger is attracted to the fixed core to move in the direction of the central axis by applying electromagnetic force from the solenoid. Black oxide treatment is performed to the yoke after the plunger housing is brazed to the yoke.

17 Claims, 2 Drawing Sheets

CONTROL VALVE AND VARIABLE DISPLACEMENT COMPRESSOR HAVING THE SAME

BACKGROUND OF THE INVENTION

The present invention relates to a rustproof control valve and a variable displacement compressor having the rustproof control valve.

Generally, in a variable displacement compressor, pressure in a crank chamber or crank chamber pressure is determined based on a balance between the amount of refrigerant gas flowing from a discharge pressure region to the crank chamber through a supply passage and the amount of refrigerant gas flowing from the crank chamber to a suction pressure region through a bleed passage. Pressure differential between the crank chamber and cylinder bores is varied by varying the crank pressure. Thereby the inclination angle of a swash plate and the strokes of pistons are adjusted. Thus the displacement of the compressor can be varied.

Japanese Unexamined Patent Publication No. 9-268974 discloses a variable displacement compressor of such type. The compressor has a suction chamber or a suction pressure region, a discharge chamber and a crank chamber or discharge pressure regions. The compressor also has a supply passage and a bleed passage. The supply passage interconnects the discharge chamber and the crank chamber. The bleed passage interconnects the crank chamber and the suction chamber. A control valve is interposed in the supply passage.

A yoke is connected to a valve housing at the middle of the control valve. A pressure sensing chamber is defined inside one end of the valve housing, and a bellows is provided in the pressure sensing chamber. A pressure sensing rod is fitted to the bellows. Suction pressure is applied to the bellows. As the suction pressure increases, that is, a heat load increases, the bellows contracts. The pressure sensing rod transmits expansion and contraction of the bellows to a valve body. A valve chamber is defined between the valve housing and the yoke, and the valve body is accommodated in the valve chamber. The valve body opens and closes a valve hole formed in the valve chamber.

The yoke includes a first yoke that connects with the valve housing and a second yoke that connects with the first yoke. A fixed core fits into the first yoke, and a plunger housing connects with the first yoke. A solenoid is held between the second yoke and the plunger housing. The fixed core is arranged in the plunger housing, and a movable core is accommodated in the plunger housing such that the movable core can approach the fixed core and separate from the fixed core.

An external controller supplies the solenoid of a solenoid mechanism with an electric current when necessary. Attraction between the cores varies with the magnitude of the electric current, and urging force for urging the movable core, that is, a load on the valve body varies. Force pressing the valve body in the direction to close the valve hole is adjusted. Thereby, a commencement point of the valve body for an internal control by the pressure in the pressure sensing chamber is adjusted. In such a state, as the suction pressure increases, the bellows contracts. Thereby, the valve body is moved in the direction to close the valve hole through the pressure sensing rod. On the contrary, as the suction pressure reduces, the bellows expands. Thereby, the valve body is moved in the direction to open the valve hole through the pressure sensing rod.

Meanwhile, the above-mentioned yoke is made of steel lumber such as a kind of aluminum killed steel SWCH12A and a kind of carbon steel S12C according to JIS, Japanese Industrial Standards. After assembling the yoke to the compressor, since the yoke is closed in the compressor, the yoke does not require rustproofing. However, upon manufacturing and assembling, the yoke requires rustproofing.

Also, since the plunger housing is previously brazed to the yoke, heat removes oil on the yoke upon brazing. Therefore, the yoke easily corrodes.

The yoke is conventionally treated by colored chromate zinc plating or rustproofing. Chromate treatment with hexavalent chromium is performed after zinc plating. Therefore, appearance and rust preventive performance of the zinc plating layer are relatively good.

An unwanted effect is that since the plunger housing previously connected to the yoke is made of stainless steel, plating with stainless steel (SUS) results in easily peeling. Therefore, after assembling the control valve, peeled plating layer may become foreign substances in the plunger housing, and may deteriorate sliding performance of the movable core. To solve the problem, for example, an elastic masking member caps the opening of the plunger housing before plating. This capping process causes manufacturing time and process of the control valve to increase. It is desired that the capping process is omitted and manufacturing time and process are reduced.

SUMMARY OF THE INVENTION

In accordance with the present invention, a control valve has a valve body for opening and closing a valve hole and a solenoid mechanism for urging the valve body by energizing a solenoid. The solenoid mechanism includes a yoke, a plunger housing, a fixed core and a plunger. The yoke accommodates the solenoid and forms a magnetic path. The plunger housing made of stainless steel connects with the yoke, and has a central axis. The fixed core connects with the yoke. The plunger is accommodated in the plunger housing and connects with the valve body. The plunger is attracted to the fixed core to move in the direction of the central axis by applying electromagnetic force from the solenoid. Black oxide treatment is performed to the yoke after the plunger housing is brazed to the yoke.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a control valve of a variable displacement compressor installed to a vehicular air conditioner according to the present invention will now be described with reference to FIGS. 1 and 2. The left side and the right side correspond to the front side and the rear side of a compressor 1 in FIG. 1, respectively.

Figure 1:
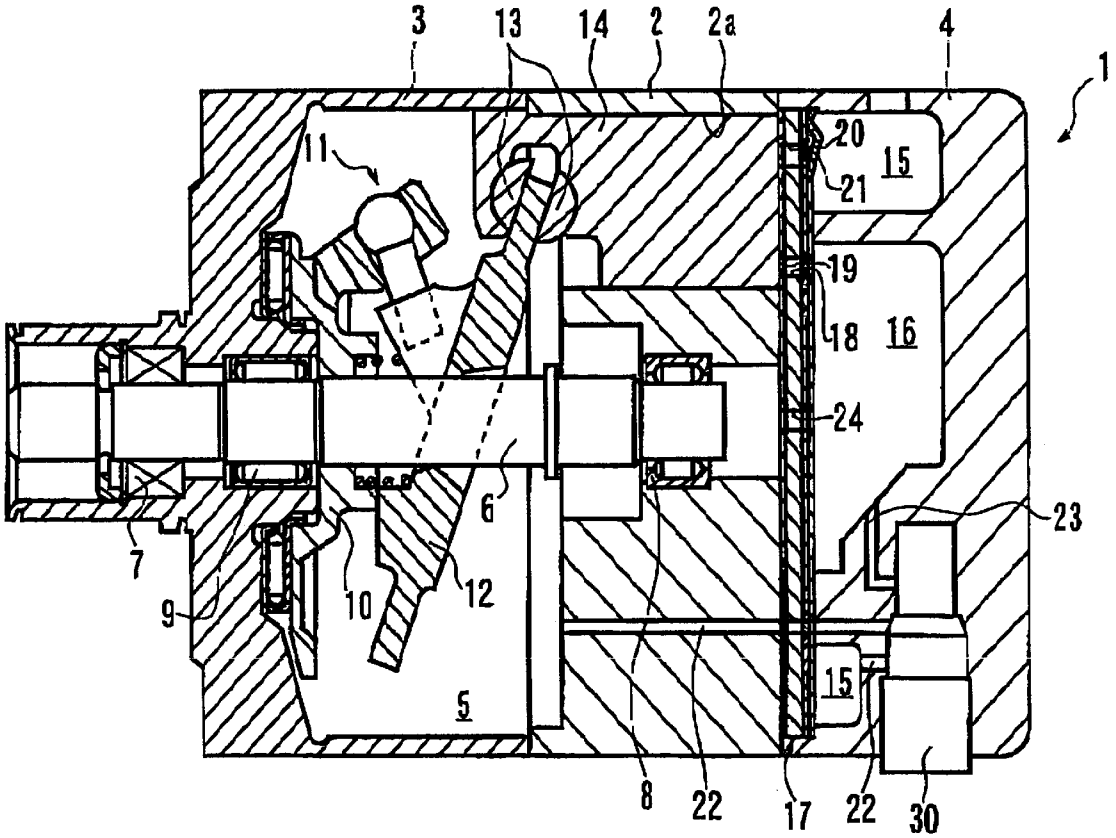
FIG. 1 is a longitudinal cross-sectional view of a variable displacement compressor according to an embodiment of the present invention.

As shown in FIG. 1, the compressor 1 has a cylinder block 2, a front housing 3 and a rear housing 4. The front housing 3 connects with the front end of the cylinder block. The rear housing 4 connects with the rear end of the cylinder block 2 through a valve plate assembly 17. The cylinder block 2, the front housing 3 and the rear housing 4 constitute a housing of the compressor 1.

A crank chamber 5 is defined between the cylinder block 2 and the front housing 3. In the crank chamber 5, a drive shaft 6 is rotatably supported by the cylinder block 2 and the front housing 3 through respective radial bearings 8 and 9. A shaft seal 7 is provided around the front end of the drive shaft 6, where the drive shaft 6 protrudes to the outside.

A lug plate 10 is secured to the drive shaft 6 in the crank chamber 5 so as to rotate integrally with the drive shaft 6. A swash plate 12 or a cam plate is accommodated in the crank chamber 5. The swash plate 12 is supported by the drive shaft 6 so as to slide and incline with respect to the drive shaft 6. Also, the swash plate 12 operatively connects with the lug plate 10 through a hinge mechanism 11. Thereby, the swash plate 12 can synchronously rotate with the lug plate 10 and the drive shaft 6, and can incline with respect to the drive shaft 6 in accordance with sliding in the direction of the central axis of the drive shaft 6.

A plurality of cylinder bores 2*a* is perforated through the cylinder block 2 in the direction of the central axis of the drive shaft 6. Each cylinder bore 2*a* accommodates a piston 14 so as to reciprocate. Each piston 14 engages with the outer periphery of the swash plate 12 through a pair of shoes 13. Thereby, rotation of the swash plate 12 due to rotation of the drive shaft 6 is converted to reciprocation of the pistons 14.

A discharge chamber 15 and a suction chamber 16 are respectively defined in the outer side and the inner side of the rear housing 4 with respect to the central axis of the drive shaft 6. The valve plate assembly 17, which forms suction valves 19 and discharge valves 21, is interposed between each cylinder bore 2*a* and the discharge chamber 15, and each cylinder bore 2*a* and the suction chamber 16.

Due to motion of each piston 14 from a top dead center toward a bottom dead center, that is, from the rear side toward the front side in FIG. 1, refrigerant gas in the suction chamber 16 is introduced into each cylinder bore 2*a* through respective suction port 18 formed in the valve plate assembly 17 by pushing respective suction valve 19 aside. Due to motion of each piston 14 from the bottom dead center toward the top dead center, that is, from the front side toward the rear side in FIG. 1, refrigerant gas introduced in each cylinder bore 2*a* is compressed to a predetermined pressure value and is discharged to the discharge chamber 15 through respective discharge port 20 formed in the valve plate assembly 17 by pushing respective discharge valve 21 aside.

Additionally, a bleed passage 24 is formed through the center of the valve plate assembly 17 to interconnect the suction chamber 16 and the crank chamber 5. A supply passage 22 extends through the cylinder block 2 and the rear housing 4 to interconnect the discharge chamber 15 and the crank chamber 5. A control valve 30 is interposed in the supply passage 22. Also, a pressure introducing passage 23 extends through the rear housing to interconnect the suction chamber 16 and the control valve 30.

The control valve 30 is accommodated in the rear housing 4, and is located at the rear side relative to the discharge chamber 15 and the suction chamber 16. A crank pressure control mechanism for controlling pressure in the crank chamber 5 or crank pressure is constituted of the supply passage 22, the a bleed passage 24 and the control valve 30.

The amount of relatively high pressure refrigerant gas that flows into the crank chamber 5 through the supply passage 22 is controlled by adjusting the opening degree of the control valve 30, and the crank chamber pressure is determined based on a balance between the amount of refrigerant gas that flows into the crank chamber 5 and the amount of refrigerant gas that flows out of the crank chamber 5 through the bleed passage 24. Pressure differential through the pistons 14 between the crank chamber pressure and pressure in the cylinder bores 2*a* varies with variation of the crank chamber pressure. Thereby, the inclination angle of the swash plate 12 varies, and the stroke of each piston 14 varies. Therefore, the displacement of the compressor 1 is adjusted.

The structure of the control valve 30, which adjusts the amount of refrigerant gas that flows in the crank chamber 5, will be described.

Figure 2:
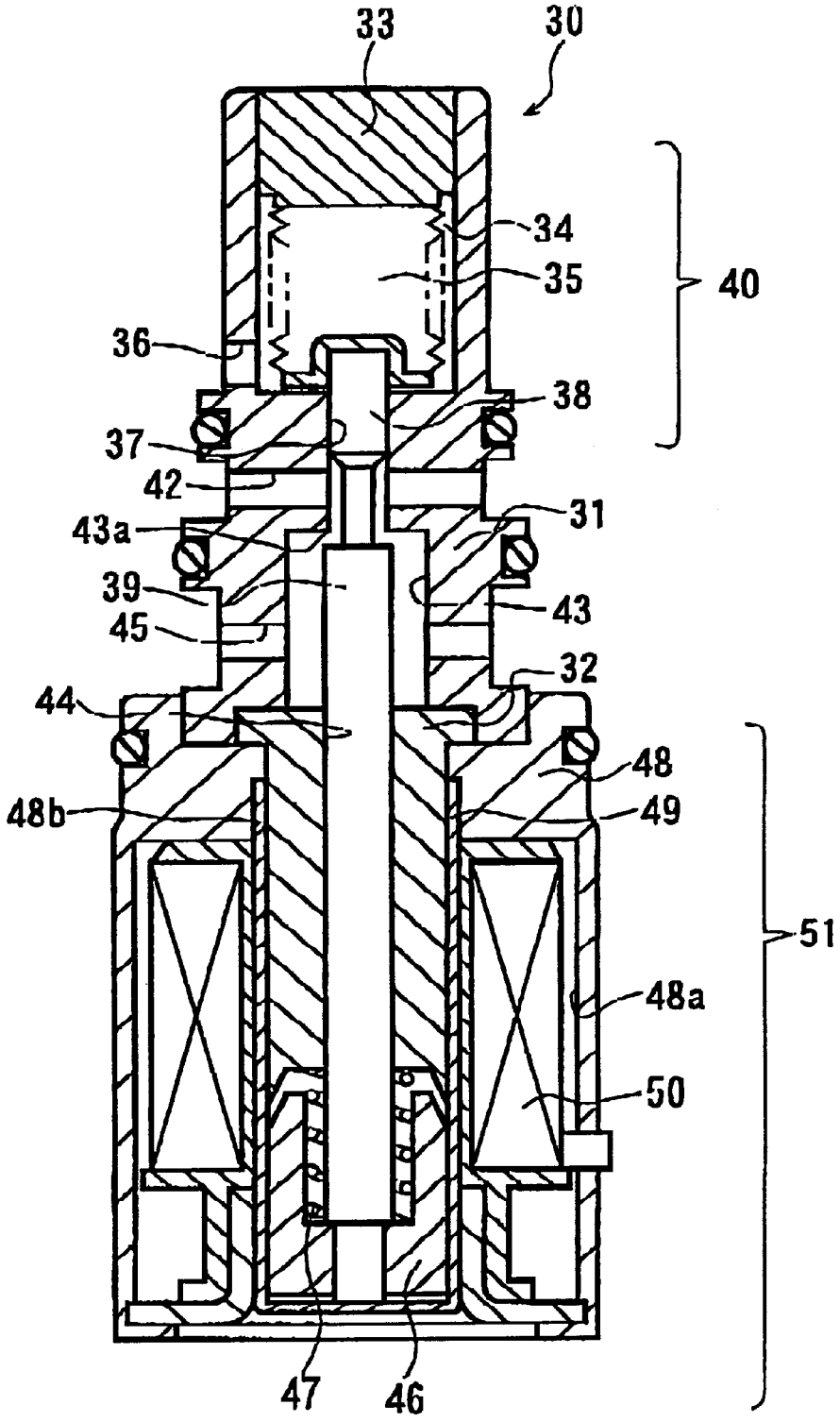
FIG. 2 is a longitudinal cross-sectional view of a control valve according to the first embodiment of the present invention.

As shown in FIG. 2, one end of a valve housing 31 or a control valve housing forms a recess, and a pressure sensing chamber 34 is defined by the recess and a cap 33 that caps the recess. A bellows 35 or a pressure sensing member is accommodated in the pressure sensing chamber 34 so as to expand and contract. The pressure sensing chamber 34 connects with the suction chamber 16 through a pressure introducing port 36 and the pressure introducing passage 23, and the suction pressure is applied in the pressure sensing chamber 34.

A pressure sensing rod 38 extends through a through hole 37, which is formed in the valve housing 31 in the axial direction of the control valve 30, and one end of the pressure sensing rod 38 fits to the bellows 35. The other end of the pressure sensing rod 38 connects with one end of a valve body 39. In the pressure sensing rod 38, a portion that connects with the valve body 39 is reduced in diameter to save a passage for refrigerant gas in the through hole 37. The pressure sensing chamber 34, the bellows 35 and the pressure sensing rod 38 constitute a pressure sensing mechanism 40. The pressure sensing mechanism 40 actuates the valve body 39 in the direction to close the through hole 37 by sensing refrigerant gas pressure by the bellows 35.

A port 42 is formed through the valve housing 31 so as to be perpendicular to the direction in which the through hole 37 extends. The port 42 connects with the crank chamber 5 through the supply passage 22. In the valve housing 31, substantially a cylindrical fixed core 32 is press-fitted to the opposite side of the pressure sensing chamber 34 relative to the valve housing 31.

A valve chamber 43 is defined by the fixed core 32 and the valve housing 31. The valve body 39 extends through the valve chamber 43 and a guide hole 44, which is formed along the axis of the fixed core 32. Additionally, the valve housing 31 at the end of the through hole 37 adjacent to the valve chamber 43 forms a valve seat 43*a*. The valve body 39 opens and closes the through hole 37 so as to approach and separate from the valve seat 43*a* in accordance with expansion and contraction of the bellows 35. A port 45 extends through the valve housing 31 so as to be perpendicular to the axial direction of the control valve 30. The port 45 connects with the discharge chamber 15 through the supply passage 22. A movable core 46 or a plunger connects with one end of the valve body 39, which is the lower end of the valve body 39 in FIG. 2, by caulking. A coil spring 47 is interposed between the movable core 46 and the fixed core 32.

Meanwhile, a yoke 48 made of steel such as a kind of aluminum killed steel SWCH12A and a kind of carbon steel S20C according to JIS is press-fitted around the valve housing 31 and the fixed core 32. The yoke 48 is substantially cylindrical in shape, and has relatively large and small diameter holes 48*a*, 48*b*. A cylindrical plunger housing 49 with a bottom at one end, which is made of stainless steel (SUS), is previously brazed into the relatively small diameter hole 48*b* before press-fitting the valve housing 31 and the fixed core 32 to the yoke 48. Thereby, the plunger housing 49 is located to surround the fixed core 32 and the movable core 46. The movable core 46 is accommodated in the plunger housing 49 so as to slide in the axial direction of the plunger housing 49. The valve body 39 is synchronously actuated with the movable core 46.

A solenoid 50 for applying electromagnetic force between the fixed core 32 and the movable core 46 is held in a cylindrical space around the plunger housing 49 in the relatively large diameter hole 48*a*. The predetermined magnitude of electric current that is supplied to the solenoid 50 is controlled due to a command transmitted from a computer, which is not shown in the drawings. A solenoid mechanism 51 is constituted of the solenoid 50, the yoke 48 that forms a magnetic path, the plunger housing 49 made of stainless steel fitted to the yoke 48, the movable core 46 and the fixed core 32.

The operation of the control valve 30 will now be described. An external controller, when necessary, supplies the solenoid 50 of the solenoid mechanism 51 with an electric current. Attraction between the cores 32 and 46 varies with the magnitude of electric current. Thereby, urging force for urging the movable core 46, that is, a load applied to the valve body 39 varies. Then threshold value of the valve body 39 for an internal control by the suction pressure in the pressure sensing chamber 34, where the internal control of the valve body 39 is started, is adjusted by adjusting force pressing the valve body 39 in the direction to close the through hole 37. In such a state, as the suction pressure increases, the bellows 35 contracts. Thereby, the valve body 39 is moved in the direction to close the through hole 37 through the pressure sensing rod 38. On the contrary, as the suction pressure reduces, the bellows 35 expands. Thereby, the valve body 39 is moved in the direction to open the through hole 37 through the pressure sensing rod 38.

Rustproofing the yoke 48 by black oxide treatment will now be described. The plunger housing 49 made of stainless steel is brazed to the yoke 48 before black oxide treatment.

The yoke 48 is degreased by immersing the yoke 48 in a degreasing solution with a temperature of 70° C., and is immersed in a black oxide solution with a temperature of 140° C. for twenty minutes, and after that is dried.

The composition of black oxide solution is various, and roughly divided into an acid series and an alkaline series. The black oxide solution utilized in the present embodiment is an alkaline series solution, which is a relatively thick sodium hydroxide solution mixed with an oxidizer, and the solution, the composition of which does not react with stainless steel upon black oxide treatment, is employed.

Also, the black oxide treatment in the present embodiment is high-temperature black oxide treatment, the temperature of the solution bath of which is 140° C. Generally, black oxide treatment means high temperature black oxide treatment.

A black layer of ferrosoferric oxide ($Fe_3O_4$) is produced on the surface of the yoke 48 other than the surface covered with the plunger housing 49 due to black oxide treatment. After the black oxide treatment, the yoke 48 is washed in water and in hot water, and then is immersed in rust-preventive oil to rustproof. The black oxide layer ensures relatively high rust preventive performance by covering the surface of the layer with the rust-preventive oil.

The following advantageous effects are obtained in the present embodiment.

(1) Rustproofed by black oxide treatment, manufacturing cost of which is lower than that of conventional colored chromate zinc plating, manufacturing cost of the control valve 30 and the compressor 1 is reduced.
(2) Since, the black oxide solution in the present embodiment does not react with the plunger housing 49 made of stainless steel, masking the plunger housing 49 is omitted. Thereby, a masking jig is not required, and a rustproofing process is simplified, and also cost is reduced.
(3) Since the black oxide solution does not contain a hexavalent chromium solution, which is utilized upon chromate plating, the black oxide treatment is effective in protecting environment.

A second embodiment of the present invention will now be described.

The black oxide treatment is performed at a relatively low temperature in the second embodiment, in place of the high-temperature black oxide treatment that is described in the first embodiment. In the present embodiment, the temperature of the black oxide solution is a room temperature, and a process of black oxide treatment is the same as that of the first embodiment.

The following advantageous effects are obtained in the present embodiment in addition to the effects described in the paragraph (1) to (3) in the first embodiment.

(4) Since the black oxide treatment is performed at a room temperature, rustproofing is further simplified, and cost is also further reduced.

The present invention is not limited to the embodiments described above, but may be modified into the following examples.

The black oxide solution in the first embodiment is an alkaline series solution, which is a relatively thick sodium hydroxide solution mixed with an oxidizer. However, as far as a black oxide solution does not react with stainless steel, for example, an acid series black oxide solution, which mainly contains sulfuric acid, may be employed.

Therefore, the present examples and embodiments are to be considered as illustrative and not restrictive and the invention is not to be limited to the details given herein but may be modified within the scope of the appended claims.

What is claimed is:

1. A control valve comprising:

a valve body opening and closing a valve hole; and a solenoid mechanism for urging the valve body by energizing a solenoid, the solenoid mechanism including:

a yoke accommodating the solenoid, the yoke forming a magnetic path;

a plunger housing made of stainless steel, the plunger housing connecting with the yoke, the plunger housing having a central axis;

a fixed core connected to the yoke; and a plunger accommodated in the plunger housing, the plunger connecting with the valve body, wherein the plunger is attracted to the fixed core to move in the direction of the central axis by applying electromagnetic force from the solenoid, and wherein black oxide treatment is performed to the yoke after the plunger housing is fixed to the yoke.

2. The control valve according to claim 1, wherein the black oxide treatment is high-temperature black oxide treatment.

3. The control valve according to claim 2, wherein a temperature of a solution bath of the black oxide treatment is approximately 140° C.

4. The control valve according to claim 1, wherein the black oxide treatment is low-temperature black oxide treatment.

5. The control valve according to claim 4, wherein a temperature of a solution bath of the black oxide treatment is approximately a room temperature.

6. The control valve according to claim 1, wherein the yoke is made of one of aluminum killed steel and carbon steel.

7. The control valve according to claim 6, wherein the yoke is made of one of SWCH12A and S12C.

8. The control valve according to claim 1, wherein a solution for the black oxide treatment is an alkaline series.

9. The control valve according to claim 8, wherein said alkaline series is a relatively thick sodium hydroxide solution mixed with an oxidizer.

10. The control valve according to claim 1, wherein a solution for the black oxide treatment is an acid series.

11. The control valve according to claim 10, wherein said acid series mainly contains sulfuric acid.

12. The control valve according to claim 1, wherein the surface of the yoke is covered with rust-preventive oil after the black oxide treatment.

13. The control valve according to claim 1, wherein the control valve is used for a variable displacement compressor.

14. A variable displacement compressor comprising:

a housing defining a discharge pressure region, a suction pressure region and a crank chamber, the discharge pressure region connecting with the crank chamber through a supply passage, the crank chamber connecting with the suction pressure region through a bleed passage;

a drive shaft supported in the housing;

a cam plate connected to the drive shaft, the cam plate being accommodated in the crank chamber to be rotated integrally with the rotation of the drive shaft; and a control valve interposed in one of the supply passage and the bleed passage, wherein the inclination angle of the cam plate with respect to the drive shaft is varied by adjusting the opening degree of the control valve, whereby the displacement of the compressor is varied, and the control valve having:

a valve body opening and closing a valve hole; and a solenoid mechanism for urging the valve body by energizing a solenoid, the solenoid mechanism including:

a yoke accommodating the solenoid, the yoke forming a magnetic path;

a plunger housing made of stainless steel, the plunger housing connecting with the yoke, the plunger housing having a central axis;

a fixed core connected to the yoke; and a plunger accommodated in the plunger housing, the plunger connecting with the valve body, wherein the plunger is attracted to the fixed core to move in the direction of the central axis by applying electromagnetic force from the solenoid, and wherein black oxide treatment is performed to the yoke after the plunger housing is fixed to the yoke.

15. The variable displacement compressor according to claim 14, wherein the compressor is a swash plate type.

16. The variable displacement compressor according to claim 15, wherein the cam plate is a swash plate.

17. A control valve for use in a variable displacement compressor having a cam plate in its crank chamber, the inclination angle of the cam plate being varied by adjusting the opening degree of one of a supply passage that interconnects a discharge pressure region and the crank chamber and a bleed passage that interconnects the crank chamber and a suction pressure region so as to vary the displacement of the compressor, the control valve comprising:

a valve body opening and closing a valve hole; and a solenoid mechanism for urging the valve body by energizing a solenoid, the solenoid mechanism including:

a yoke accommodating the solenoid, the yoke forming a magnetic path;

a plunger housing made of stainless steel, the plunger housing connecting with the yoke, the plunger housing having a central axis;

a fixed core connected to the yoke; and a plunger accommodated in the plunger housing, the plunger connecting with the valve body, wherein the plunger is attracted to the fixed core to move in the direction of the central axis by applying electromagnetic force from the solenoid, and wherein black oxide treatment is performed to the yoke after the plunger housing is fixed to the yoke.

* * * * *

UNITED STATES PATENT AND TRADEMARK OFFICE

CERTIFICATE OF CORRECTION

PATENT NO. : 6,739,843 B2
DATED : May 25, 2004
INVENTOR(S) : Umemura et al.

It is certified that error appears in the above-identified patent and that said Letters Patent is hereby corrected as shown below:

Column 4,
Line 4, please delete “the a bleed passage” and insert therefore -- the bleed passage --.

Signed and Sealed this

Fourteenth Day of September, 2004

JON W. DUDAS
*Director of the United States Patent and Trademark Office*